US005505426A

United States Patent [19]

Whitby et al.

[11] Patent Number: 5,505,426

[45] Date of Patent: Apr. 9, 1996

[54] HYDRAULICALLY CONTROLLED BLOWOUT PREVENTER

[75] Inventors: Melvyn F. Whitby; David L. O'Donnell, both of Houston; Tri C. Le, Spring, all of Tex.

[73] Assignee: Varco Shaffer, Inc., Houston, Tex.

[21] Appl. No.: 417,520

[22] Filed: Apr. 5, 1995

[51] Int. Cl.[6] ..... E21B 33/06

[52] U.S. Cl. ..... 251/1.3; 251/1.1

[58] Field of Search ..... 251/1.1, 1.3

[56] References Cited

U.S. PATENT DOCUMENTS

| | | | |
|---|---|---|---|
| 1,819,875 | 8/1931 | Cunningham | 251/1.3 X |
| 4,349,041 | 7/1982 | Bates | 251/1.3 X |
| 5,199,683 | 4/1993 | Le . | |

OTHER PUBLICATIONS

Cover page of Sentinel™ Installation, Operation, and Maintenance Manual.

*Primary Examiner*—John C. Fox

*Attorney, Agent, or Firm*—Browning, Bushman, Anderson & Brookhart

[57] ABSTRACT

A hydraulically controlled blowout preventer 10 and method are disclosed for simultaneously moving two sealing assemblies 24, 27 to seal around an oilfield tubular 15 within the bore 14 of BOP 10. A single manual operator 20 may be rotated to simultaneously move master piston 26 and hydraulically interconnected slave piston 79 inwardly toward bore 14 or outwardly away from bore 14, respectively. BOP 10 is field convertible to purely hydraulic operation by disconnecting the threaded shaft 52 from master piston 26. Hydraulic lines 36 and 40 interconnect between cylinders 30 and 82 to result in simultaneous operation of seal assemblies 24, 27.

20 Claims, 1 Drawing Sheet

HYDRAULICALLY CONTROLLED BLOWOUT PREVENTER

FIELD OF THE INVENTION

The present invention relates generally to blowout preventers and, more particularly, to blowout preventers of the type having either a pair of seal assemblies for sealing engagement with an oilfield tubular or a pair of shear assemblies for shearing a line or tubular passing through the blowout preventer.

BACKGROUND OF THE INVENTION

BOPs have been used for decades in oilfield operations as safety equipment for controlling a well. Blowout preventers generally are of the type designed to seal the exterior of an oilfield tubular, or are of the type designed to shear a line or tubular passing through the BOP. The present invention relates to both sealing and shearing type blowout preventers.

A significant factor relating to the utilization of blowout preventers relates to the cost of manufacturing, maintaining, and operating the equipment. Those skilled in the art of BOPs have recognized the advantages of hydraulically operated BOP rams, so that sealing assemblies or shearing assemblies can be simultaneously brought into engagement with the oilfield tubular under a substantially equal fluid pressure. Accordingly, many high-cost BOP applications supply hydraulic power to the BOP to operate simultaneously against two pistons and opposing ram assemblies to both close and open the BOP.

Relatively inexpensive blowout preventer assemblies may not easily achieve this objective because of the high cost associated with supplying continuous hydraulic power to the BOP. In lower-cost applications, BOPs may either be manually operated, or may be powered by a drive mechanism that mechanically rotates a shaft with respect to the blowout preventer body to move each ram assembly into engagement with the oilfield tubular. A manually operated blowout preventer may be closed simultaneously by two individuals, or one side of the BOP assembly may be closed, then the other side of the BOP closed. In emergency situations, the required time for safely achieving this operation is critical.

Some competitively priced blowout preventer assemblies that do not require the high cost associated with supplying the BOP with hydraulic pressure may nevertheless achieve substantially simultaneous closing of the BOP ram assemblies. The Sentinel blowout preventer manufactured and sold by Varco Shaffer, Inc. utilizes a drive motor to rotate a shaft exterior of the BOP body. Each end of the shaft is provided with a sprocket, and a pair of chains are used to simultaneously rotate the threaded shafts on opposing sides of the BOP body, thereby simultaneously closing the sealing ram assemblies on the oilfield tubular. The Sentinel BOP, however, does require the cost of a drive motor, and the exterior shaft may interfere with other equipment about the oil well recovery site. Also, the mechanical connection between a single powered drive shaft and the pair of driven shafts each housed at opposing sides of the BOP body is provided by chains, which must be properly checked and maintained.

Accordingly, there is a need to lower the cost of manufacturing and maintaining blowout preventers. There is also a need to provide a blowout preventer that will easily achieve simultaneous closing of the opposing pair of ram assemblies without incurring the cost associated with providing hydraulic fluid to power the blowout assembly rams.

The disadvantages of the prior art are overcome by the present invention, and an improved blowout preventer assembly is hereinafter disclosed. The blowout preventer of the present invention reduces the cost of manufacturing and maintaining a ram-type blowout preventer. Those skilled in the art have long sought and will appreciate the novel features of the present invention.

SUMMARY OF THE INVENTION

The blowout preventer of the present invention satisfies a number of design, operational, and economic criteria for BOPs that may be used in workover, well servicing, fracking, and drilling operations. The BOP design permits either manual or hydraulic operation. Manual operation utilizes improved techniques that reliably open and close both ram assemblies. The BOP of the present invention may be manufactured as a lightweight, easily transportable assembly that is easy to install and is capable of reliable operation over a long life.

To close both seal ram assemblies simultaneously, one drive shaft having a threaded portion may be rotated relative to the BOP body to move the drive shaft axially along a first valve stem axis, which also moves a first piston in a first chamber. A similar mechanism provided on the opposing side of the BOP includes a slave piston movable in a second chamber. The first and second chambers are fluidly connected so that axial movement of the first piston results in opposing axial movement of the second piston, and thus simultaneous closing of the seal ram assemblies each interconnected with a respective piston. The drive shaft may be rotated in the opposite direction to open the ram assemblies.

The BOP assembly may also be easily modified to receive hydraulic power to both ram assemblies for directly moving both the first and the second pistons. The open and close ports in the BOP body that receive the respective first and second shafts may be connected to an accumulator unit to supply hydraulic power to open and close the blowout preventer. The assembly may thus be easily converted from a manual to a hydraulic operation in the field.

It is an object of the present invention to provide a highly reliable BOP that will simultaneously move a pair of ram assemblies into engagement with an oilfield tubular. The assembly of the present invention achieves this objective by providing a mechanism for rotating a drive shaft having threads that cause the drive shaft to move along a first valve stem axis, thereby moving a first piston within a first chamber. A second piston is axially movable along a second valve stem axis within a second chamber, and the chambers within the BOP body are fluidly connected for effectively supplying fluid pressure to simultaneously close both ram assemblies by rotating the single drive shaft. The drive shaft may be interconnected with a handle for manually rotating the drive shaft, or may be rotated by a power unit, such as an electric motor and gearbox mechanism.

It is a feature of the present invention that the mechanical energy transmitted through the drive shaft of a blowout preventer is converted into hydraulic energy that is simultaneously supplied to opposing rams of the BOP. This feature reduces the costs associated with directly powering two pistons and achieves the benefits of a balanced hydraulic circuit to effectively reduce the energy required to reliably close the BOP ram assemblies.

It is an advantage of the present invention that both sides of the BOP assembly remain substantially identical so that parts may be easily interchanged. It is also an advantage of the present invention that the BOP may be easily modified so that the slave side of the BOP becomes the drive side of the BOP, and the drive side of the BOP becomes the slave side of the BOP. As previously noted, the BOP assembly of the present invention may be easily converted from the BOP that is powered by mechanical rotation of the drive shaft with respect to the BOP body to a BOP that is supplied with hydraulic fluid pressure from an accumulator for the simultaneous closing of the ram assemblies.

These and further objects, features, and advantages of the present invention will become apparent from the following detailed description, wherein reference is made to figures in the accompanying drawings.

While the present invention will be described in connection with presently preferred embodiments, it will be understood that it is not intended to limit the invention to those embodiments. On the contrary, it is intended to cover all alternatives, modifications, and equivalents included within the spirit of the invention and as defined in the appended claims.

DESCRIPTION OF THE PREFERRED EMBODIMENTS

The BOP of the present invention provides a rugged, compact, relatively lightweight, and easily transportable sealing mechanism that provides advantages over other BOPs designed for similar operations. Although the BOP of the present invention may be used with an inexpensive manual operator, it is readily adaptable for low-cost motorized operation using a low-maintenance, non-bulky power source. The present invention is also readily adaptable for purely hydraulic operation. Adaptation between manual, motor powered, or hydraulic operation can easily be made in the field.

Figure 1:
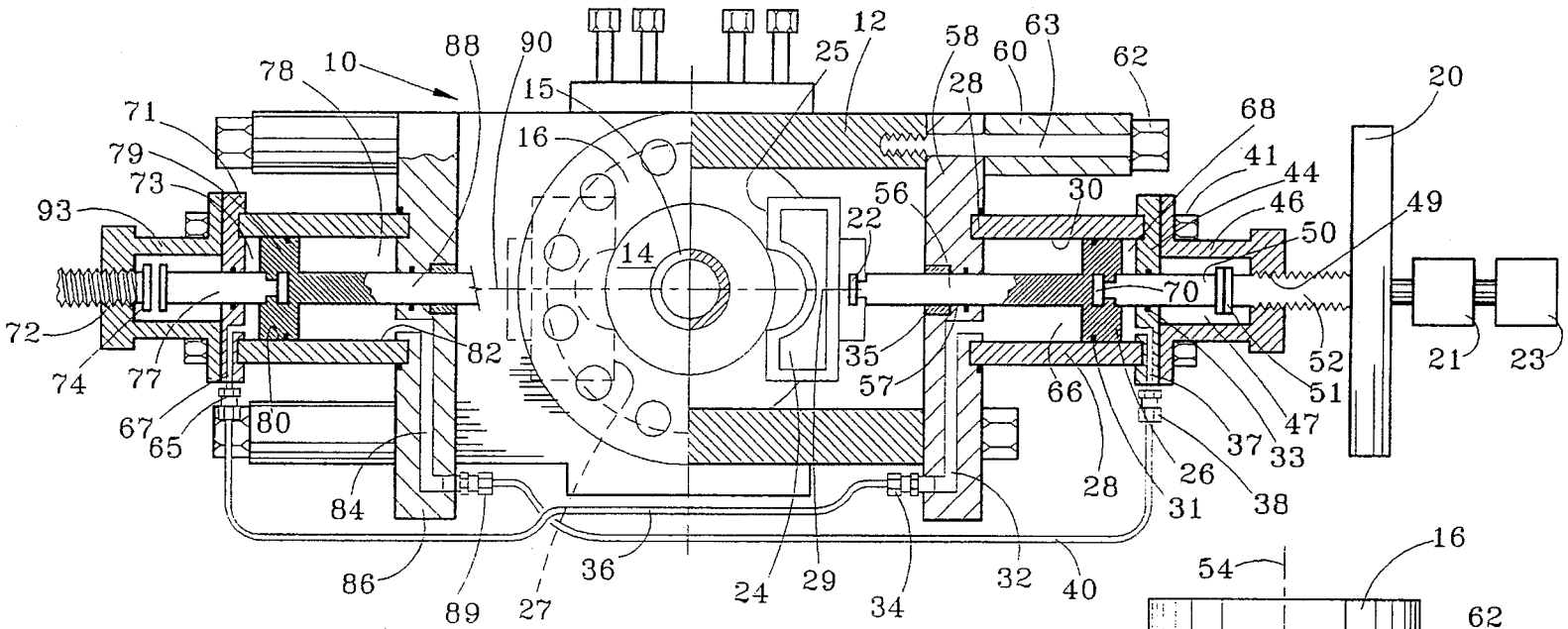
FIG. 1 is a top view of a suitable manually operated blowout preventer according to the present invention, with the right side and a portion of the left side of a blowout preventer shown in cross-section.

With reference now to the drawings and more specifically to FIG. 1, there is shown a BOP 10 in accord with the present invention. A suitable sealing assembly for a blowout preventer 10 according to the present invention may be of the type commercially available from Varco Shaffer, Inc. in Houston, Tex. An exemplary representative sealing assembly is disclosed in U.S. Pat. No. 5,199,683, which is incorporated herein by reference.

Figure 2:
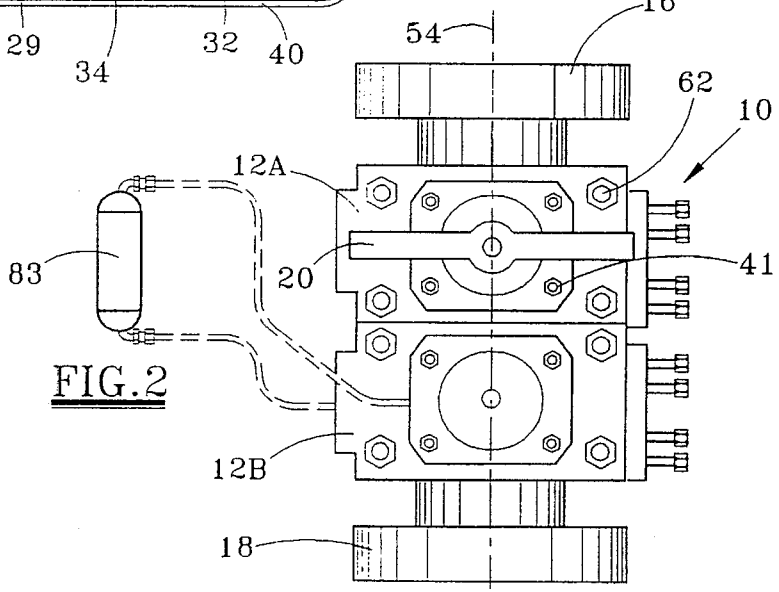
FIG. 2 is a side view of a suitable blowout preventer according to the present invention. The blowout preventer comprises an upper BOP sealing ram assembly and a lower BOP sealing ram assembly.

BOP 10 includes a BOP body 12 having a central bore 14 therethrough for receiving an oilfield tubular 15. Flanges 16 and 18 (see FIG. 2) are preferably disposed above and below BOP 10 for connection to a wellhead (not shown) as is well known to those skilled in the art. The BOP body may alternatively be equipped with end connection other than flanges. FIG. 2 discloses stacked BOP bodies 12A and 12B, respectively, that provide additional well control flexibility. The BOP of this invention may comprise either a single body or stacked bodies. A manual operator or handle 20 provides an inexpensive, lightweight means for operating BOP 10. A manual operator may also include an extension with a standard U-joint. A hand wheel may also be used. If desired, a motorized operator 23 having gears in a gearbox, if necessary, or other adaptive drive means 21 may also be used to open and close the BOP 10 about oilfield tubular 15 using seal assemblies such as seal assembly 24 to control sealing of bore 14 as desired. Motor operator 23 could be of various types, including a pneumatic or electric motor.

For convenience, a first side of BOP 10 construction will be described in detail, and it will be understood that the opposite side is similar in construction and that the components are interchangeable to thereby promote ease of installation and maintenance. Subsequently, both sides of BOP 10 will be referenced to describe the interaction of components during operation thereof.

Seal assembly 24 seals around tubular 15 in bore 14. For this purpose, seal assembly 24 includes a seal member, such as seal member 25, that is typically of elastomeric construction. Seal assembly 24 is removably connectable to piston shaft 56 with integral piston 26 by connector 22. Piston 26 drives seal assembly 24 axially to engage and disengage tubular 15 as piston 26 reciprocates within a first chamber 30. First chamber 30 is defined internally of chamber body or cylinder housing 28. As handle 20 is rotated typically in a clockwise direction, or as a result of other drive means, piston 26 may move inwardly toward bore 14, thereby driving seal assembly 24 inwardly along stem axis 29.

As piston 26 moves inwardly toward bore 14, it simultaneously drives hydraulic fluid through BOP hydraulic passageway 32. Passageway 32 extends through first BOP end plate 58 and fluidly communicates with hydraulic line 36 via hydraulic connector, coupling, or fitting 34, which may include a threaded or quickconnect securing means. Piston 26 preferably has a circumferential seal element 31 to sealingly separate chamber 30 into two portions, as will be discussed hereinafter. Ram shaft packing 35 and seal 33 define the pressure sealed region within first chamber 30 which is separated into two sealed chambers 66 and 68 by the piston 26. The passageways and sealed regions could be differently configured. For instance, all hydraulic passageways could be internal to BOP 10. Other variations may also occur to those skilled in the art after studying the teachings of this specification.

When piston 26, which in the present configuration acts as a master piston, drives hydraulic fluid outwardly from the first chamber 66 through hydraulic line 36, a reciprocal flow of hydraulic fluid flows inwardly to the second chamber through hydraulic line 40. Hydraulic line 40 fluidly communicates through hydraulic coupling, fitting, or connector 38 to internal passageway 37, defined within head member 44.

End cap 46 is secured by bolts 41 to head member 44. Head member 44 is mounted to piston cylinder 28, and in cooperation with end plate 58 forms cylinder chamber 30. End cap 46 provides a threaded port 49 to engage threaded shaft 52° Flange connection 51 connects threaded shaft 52 with non-threaded shaft 50, which includes button end 70 for interconnection with piston 26. The connector 70 thus axially connects the non-threaded shaft with the piston while permitting rotation of the shaft 50 with respect to the axially movable but non-rotatable piston 26. As handle 20 is rotated, threaded port 49 and threaded shaft 52 act in worm gear fashion to move shaft 50 axially along stem axis 29 to thereby drive piston 26 toward bore 14. As piston 26 moves toward bore 14, the seal assembly engages the tubular 15. Stem axis 29 is preferably substantially perpendicular or orthogonal to central bore axis 54 of BOP 10 (see FIG. 2). End cap 46 also defines cavity 47 therein surrounding non-threaded shaft 50. Cavity 47 need not be sealed.

BOP body 12 includes end plate 58 to which cylinder housing 28 is mounted. End plate 58 is secured to BOP body 12 by tightening nuts, such as nut 62 mounted on support rod 63, which extends through spacer 60. Ram or seal assembly 24 is easily changed out by removing nuts 62 and sliding end plate 58 and other components outwardly along support rod 63. End plate 58 defines central passageway 57 therein. Piston shaft 56 reciprocates within central passageway 57 to open and close bore 14 with seal assembly 24. End plate 58 also includes passageway 32 to provide a flow path for hydraulic fluid in the presently preferred embodiment.

In operation, piston 26 divides chamber 30 into two separately pressurized inner and outer regions 66 and 68, respectively. Rotation of handle 20 produces axial and rotational movement of shaft 50, which engages piston 26 through the button end 70. The axial movement of shaft 50 toward bore 14 is applied to piston 26, which does not rotate due to button connection 70. Piston 26 drives seal assembly 24 toward bore 14 in the manner explained hereinbefore.

Piston 26 also forces hydraulic fluid out of first inner region 66 and into hose 36, through connector 65, through passageway 67 in second head member 71, and finally into second outer cavity 73. Threaded shaft 72, connection 74, and nonthreaded shaft 77 are the same as threaded shaft 52, connection 51, and non-threaded shaft 50, respectively, although the flange connection 74 is not bolted together. Either one of the opposing flange connections (but not both) may thus be connected for operation of both opposing seal assemblies with a single control unit. Common connectors such as bolts (not shown) may be used to selectively interconnect the flange connection.

As a result of pressure buildup in second outer cavity 73, slave piston 79 moves inwardly toward bore 14 along axis 90 simultaneously with master piston 26. Axis 90 is preferably coaxial with axis 29, so that the force applied by the ram blocks is directly opposing. Slave piston 79 is also connected to non-threaded shaft 77 by a similar button connector 70.

Second outer cavity 73 and second inner cavity 78 are pressure separated by circumferential piston seal 80 with respect to each other. Cavities 73 and 78 delineate second chamber 82 that is similar to first chamber 30. As slave piston 79 moves inwardly toward bore 14 simultaneously with master piston 26, second inner cavity 78 is pressurized to force hydraulic fluid through passageway 84 in second end plate 86, through hydraulic coupling or fitting 89, which may be of the threaded or quick-connect type coupling, through hydraulic line 40, and finally back into first outer cavity 68. Thus, both ram blocks 24 and 27 move inwardly simultaneously, with the same pressure, to seal around tubular 15 within bore 14.

When opening BOP 10, handle 20 may be rotated, typically in a counterclockwise direction, to thereby move shaft 50 in an axial direction away from bore 14. As shaft 50 moves outwardly from bore 14, piston 26 also moves outwardly due to button connection 70. Therefore, seal assembly 24 also moves away from bore 14. As piston 26 moves away from bore 14, it forces hydraulic fluid out of first outer chamber 68 through hydraulic line 40 and into second inner chamber 78 to thereby cause slave piston 79 to simultaneously axially move shaft 88 outwardly away from bore 14 along second stem axis 90. Therefore, sealing assembly 27 also moves outwardly from bore 14 for simultaneous outward movement of first and second ram blocks 24 and 27.

As slave piston 79 continues to move outwardly, hydraulic fluid is evacuated from second outer cavity 73, back through hydraulic line 36, and into first inner cavity 66. Thus, the hydraulic fluid flows back and forth between the two sealed sets of cavities during opening and closing to place the same opening and closing pressures simultaneously on pistons 26 and 79 for simultaneous operation of ram blocks 24 and 27. The result is an inexpensive and effective means for simultaneously opening and closing sealing members in a BOP with a single manual operator. Furthermore, the hydraulic mechanism for operating both sealing members simultaneously is relatively simple to manufacture, is rugged, and requires little maintenance or adjustment. Manual operation of handle 20 tends to require less torque to operate because of the balanced operation. The hydraulic operation of the two seal assemblies simultaneously also tends to be more efficient than a purely mechanical operation of the two seal assemblies.

The left side of the BOP 10 is provided with an end cap 93 similar to end cap 46. Both sides of the BOP may thus be identical except as explained above, and accordingly the seals and other components shown on the left side of the BOP are not discussed again below. As previously noted, drive handle 20 may be easily switched to the second side of BOP 10 as may be more convenient for operation, depending on the surroundings of BOP 10 at the wellsite.

As well, BOP 10 can be quickly converted to hydraulic operation in the field. For instance, hydraulic pump means such as accumulator 83 may be connected as schematically indicated in FIG. 2 for this purpose. The hydraulic connections would preferably be configured to effectively provide the operation as that described above. In this application, the non-threaded shaft 50 would be disconnected from the threaded shaft 52 at the bolted connection 51. The hydraulic connections 34 and 38 may be switched so that the left side outer chamber 93 and the right side outer chamber 68 are ported together (in fluid communication). The left side inner chamber and the right side inner chamber 66 will also be ported together. Neither of the threaded shafts is thus connected to the respective non-threaded shaft. A tee may be installed in closing line 36 and opening line 40, and the open and close lines from the accumulator 83 then connected at the tees to the appropriate lines 36 and 40.

While the preferred embodiment includes a drive shaft 50 to directly drive piston 26, a manual pump driven by a handle 20 or other manual hydraulic pump could be used to drive the piston from a distance separated from BOP 10. Other interconnections between the components herein may also be used, as will be understood by those skilled in the art after studying the teachings of this specification.

As is known to those skilled in the art, it may be desirable to equalize pressures above and below the ram assemblies in bore 14 as taught in U.S. Pat. No. 5,199,683, to allow an easier, smoother opening of BOP 10 while preventing seal assemblies from wearing or becoming slightly off center due to a differential pressure across the seal assemblies.

The concepts of the :present invention may also be applied to a shear ram BOP for simultaneous shearing of a member by opposing shear blades simultaneously moved by a single drive unit, such as handle 20. The seal assemblies described above may thus be replaced with shear ram assemblies for this embodiment.

The foregoing disclosure and description of the invention is illustrative and explanatory thereof, and it will appreciated by those skilled in the art that various changes in the size, shape, and materials, as well as in the details of the illustrated construction or combinations of features of the various BOP elements, may be made without departing from the spirit of the invention.

What is claimed is:

1. A blowout preventer having a central tubular axis for receiving an oilfield tubular, the blowout preventer comprising:

a BOP body having a central bore therethrough for receiving the oilfield tubular, the BOP body having a first chamber therein and a second chamber therein;

a first rotatable shaft having a first threaded body portion for moving the first shaft with respect to the BOP body along a first axis substantially perpendicular to the central tubular axis;

a first ram assembly interconnected with the first shaft for engagement with the oilfield tubular upon axial movement of the first shaft with respect to the BOP body;

a second ram assembly for engagement with the oilfield tubular upon axial movement of the second ram assembly with respect to the BOP body;

a first piston interconnected with the first shaft and axially movable within the first chamber along the first axis, the first piston separating the first chamber into a first BOP facing chamber and a first outward chamber spaced outward from the first BOP facing chamber with respect to the BOP body central bore;

a second piston interconnected with the second ram assembly and axially movable within the second chamber along a second axis substantially perpendicular to the central tubular axis, the second piston separating the second chamber into a second BOP facing chamber and a second outward chamber spaced outward from the second BOP facing chamber with respect to the BOP body central bore; and fluid flow lines interconnecting the first BOP facing chamber and the second outward chamber and interconnecting the second BOP facing chamber and the first outward chamber, such that the first and second pistons simultaneously move along the respective first and second axis for simultaneously moving the respective first and second ram assemblies into engagement with the oilfield tubular.

2. The BOP assembly as defined in claim 1, further comprising:

an attachment mechanism for selectively connecting and disconnecting the first rotatable shaft and the first piston; and the second piston including a second attachment mechanism for selectively connecting and disconnecting a second shaft thereto, the second shaft having a threaded body portion for moving the second piston with respect to the BOP body along the second axis.

3. The BOP assembly as defined in claim 1, further comprising:

an attachment mechanism for selectively connecting and disconnecting the first rotatable shaft and the first piston, the attachment mechanism being spaced exterior of the first chamber.

4. The BOP assembly as defined in claim 1, further comprising:

a connector for axially interconnecting the first rotatable shaft and the first piston while permitting rotation of the first shaft with respect to the first piston.

5. The BOP assembly as defined in claim 1, wherein:

the fluid flow lines comprise a first tubular portion external of the BOP body, and a second tubular portion passing through one or more flow paths within the BOP body.

6. The BOP assembly as defined in claim 1, further comprising:

a handle for manually rotating the first shaft with respect to the BOP body.

7. The BOP assembly as defined in claim 1, further comprising:

a power drive mechanism for rotating the first shaft.

8. The BOP assembly as defined in claim 7, wherein the power drive mechanism comprises a motor having a rotating motor shaft and a gearbox assembly interconnecting the motor shaft and the first shaft.

9. The BOP assembly as defined in claim 1, wherein each of the first and second ram assemblies includes a metal ram body and an elastomeric member carried on the metal body for sealing engagement with the oilfield tubular.

10. A blowout preventer for sealing an oilfield tubular having a central tubular axis, the blowout preventer comprising:

a BOP body having a central bore therethrough for receiving the oilfield tubular, the BOP body having a first chamber therein and a second chamber therein;

a first rotatable shaft for moving the first shaft with respect to the BOP body along a first axis substantially perpendicular to the central tubular axis;

a first seal ram assembly interconnected with the first shaft for sealing engagement with the oilfield tubular upon axial movement of the first shaft with respect to the BOP body, the first seal ram assembly including a first metal body and a first elastomeric member carded on the metal body;

a second seal ram assembly for sealing engagement with the oilfield tubular upon axial movement of the second seal ram assembly with respect to the BOP body, the second seal ram assembly including a second metal body and a second elastomeric member carried on the metal body;

a first piston interconnected with the first shaft and axially movable within the first chamber along the first axis, the first piston separating the first chamber into a first BOP facing chamber and a first outward chamber spaced outward from the first BOP facing chamber with respect to the BOP body central bore;

a second piston interconnected with the second seal ram assembly and axially movable within the second chamber along a second axis, the second piston separating the second chamber into a second BOP facing chamber and a second outward chamber spaced outward from the second BOP facing chamber with respect to the BOP body central bore; and fluid flow lines interconnecting the first BOP facing chamber and the second outward chamber and interconnecting the second BOP facing chamber and the first outward chamber, such that the first and second pistons simultaneously move along the respective first and second axis for simultaneously moving the respective first and second seal ram assemblies into sealing engagement with the oilfield tubular.

11. The BOP assembly as defined in claim 10, wherein:

the fluid flow lines comprise a first tubular portion external of the BOP body, and a second tubular portion passing through one or more flow paths within the BOP body.

12. The BOP assembly as defined in claim 10, further comprising:

a handle for manually rotating the first shaft with respect to the BOP body.

13. The BOP assembly as defined in claim 10, further comprising:

a power drive mechanism for rotating the first shaft.

14. The BOP assembly as defined in claim 10, comprising:

an attachment mechanism for selectively connecting and disconnecting the first rotatable shaft and the first piston, the attachment mechanism being spaced exterior of the first chamber.

15. The BOP assembly as defined in claim 10, further comprising:

a connector for axially interconnecting the first rotatable shaft and the first piston while permitting rotation of the first shaft with respect to the first piston.

16. A method for closing opposing ram assemblies of a blowout preventer having a central tubular axis, the method comprising:

forming a BOP body having a first chamber therein and a second chamber therein;

interconnecting a first ram assembly with a shaft;

interconnecting a first piston with the shaft, the first piston separating the first chamber into a first BOP facing chamber and a first outward chamber spaced outward from the first BOP facing chamber with respect to the BOP body central bore;

interconnecting a second piston and a second ram assembly, the second piston separating the second chamber into a second BOP facing chamber and a second outward chamber spaced outward from the second BOP facing chamber with respect to the BOP body central bore;

fluidly interconnecting the first BOP facing chamber and the second outward chamber and interconnecting the second BOP facing chamber and the first outward chamber such that the first and second pistons simultaneously move in opposite directions in response to fluid pressure; and rotating the shaft with respect to the BOP body to move the shaft axially along an axis substantially perpendicular to the central tubular axis, thereby moving both the first and second pistons and the respective first and second ram assemblies.

17. The method as defined in claim 16, further comprising:

manually rotating the shaft with respect to the BOP body.

18. The method as defined in claim 16, further comprising:

rotating the shaft with a powered drive mechanism.

19. The method as defined in claim 16, further comprising:

axially interconnecting the shaft and the first piston while permitting rotation of the shaft with respect to the first piston.

20. The method as defined in claim 16, further comprising:

selectively connecting the shaft and the first piston; and selectively connecting a second shaft and the second piston.

* * * * *